US009555523B2

(12) United States Patent
Richardson et al.

(10) Patent No.: US 9,555,523 B2
(45) Date of Patent: Jan. 31, 2017

(54) SOCKET COUPLING RECEPTACLE

(76) Inventors: Perry J. Richardson, Los Gatos, CA (US); Bruce Richardson, Los Gatos, CA (US)

( * ) Notice: Subject to any disclaimer, the term of this patent is extended or adjusted under 35 U.S.C. 154(b) by 1303 days.

(21) Appl. No.: 13/467,788

(22) Filed: May 9, 2012

(65) Prior Publication Data

US 2012/0285298 A1 Nov. 15, 2012

Related U.S. Application Data

(60) Provisional application No. 61/484,055, filed on May 9, 2011.

(51) Int. Cl.
*B25B 13/06* (2006.01)

(52) U.S. Cl.
CPC ..... *B25B 13/06* (2013.01)

(58) Field of Classification Search
CPC .... B25B 13/06; B25B 13/065; B25B 25/0035; B25B 25/005
USPC ..... 81/121.1, 124.6
See application file for complete search history.

(56) References Cited

U.S. PATENT DOCUMENTS 975,285 A 11/1910 Robertson
2,202,240 A 5/1940 Trotter
2,397,216 A * 3/1946 Stellin ..... F16B 23/0007 411/404
2,777,353 A * 1/1957 Willis ..... F16B 23/0038 411/403
3,079,819 A * 3/1963 Wing ..... B25B 13/065 81/124.6
3,620,106 A 11/1971 Dixon
4,993,289 A * 2/1991 Parks ..... B25B 23/0035 81/121.1
5,171,117 A * 12/1992 Seidl ..... B25B 15/005 411/404
5,429,018 A 7/1995 Miller
5,910,197 A * 6/1999 Chaconas ..... B25B 23/0035 81/124.6
6,390,929 B2 * 5/2002 Hyatt ..... B21K 5/16 470/16
6,729,208 B1 * 5/2004 Chrzanowski ..... B25B 27/18 81/120
7,228,764 B1 * 6/2007 Macor ..... B25B 13/06 81/121.1

* cited by examiner

*Primary Examiner* — Hadi Shakeri
(74) *Attorney, Agent, or Firm* — Thomas Schneck; David Schneck

(57) ABSTRACT

An interchangeable socket for a socket wrench or other tool is disclosed. The socket has a fastener-receiving end, dimensioned to receive and fit a specified fastener. The socket has a post-receiving end dimensioned to receive and fit a square cross-section drive post. The post-receiving end has a square cross-section hollow bounded by four walls intersecting at corners of the hollow. The post-receiving end has guide surfaces that intersect with the four walls and each other. The guide surfaces cooperate with the drive post to rotate and align the drive post with the square cross-section hollow. The guide surfaces are symmetric with respect to the four walls. The guide surfaces are symmetric with respect to the corners of the square cross-section hollow.

3 Claims, 6 Drawing Sheets

SOCKET COUPLING RECEPTACLE

CROSS-REFERENCE TO RELATED APPLICATION

This application claims priority from U.S. provisional application Ser. No. 61/484,055 filed May 9, 2011.

TECHNICAL FIELD

The field of the present disclosure pertains generally to tools, more specifically to interchangeable sockets as used with socket wrenches, nut drivers and other tools having a drive post.

BACKGROUND

A socket wrench set commonly includes a socket wrench 102 and interchangeable sockets in various sizes. The socket wrench 102 has a drive post 106 or shank, usually of quarter (¼) inch drive, three eighths (⅜) inch drive or half (½) inch drive, onto which a socket 104 fits, as shown in FIGS. 1-3. Sockets are available in metric or English sizes, to fit metric or English hex bolts or nuts respectively. Usually, each socket has a six point receptacle 108 or socket, or a twelve point receptacle or socket (not shown, but widely known and readily understood) at one end of the socket body, and a square receptacle 302 at an opposed end of the socket body 304, although other types of sockets fitting other types of specified fasteners are known. The six point socket, also known as a hex socket, or the twelve point socket is sized to fit the bolt head or nut, and is usually just slightly larger across than the bolt head or nut so as to allow for working clearance. The square receptacle 302 is sized to fit the drive post 106 or shank of the socket wrench 102, and is sized slightly larger across so as to allow for working clearance. Usually, the drive post 106 or shank of the socket wrench 102 and the socket 104 have a ball-detent mechanism (not shown, but readily understood), with the drive post 106 or shank having one, two or four balls that are either spring-loaded and retractable by pressing or retractable with the use of a spring-loaded post 202 extending from the top 204 of the ratchet mechanism 206 on the socket wrench 102. Each socket has a corresponding set of four depressions equally spaced inside of the square receptacle 302, into which the ball or balls of the drive post 106 or shank fit.

In order to insert the drive post 106 or shank of the socket wrench 102 into the square receptacle 302 of the socket 104, the drive post 106 is aligned rotationally and longitudinally with the square receptacle 302 of the socket 104 as shown in FIG. 3, and the socket 104 is pushed onto the socket wrench 102, with the drive post 106 mating with the square receptacle 302. If the socket 104 is not correctly oriented relative to the drive post 106, the socket 104 cannot be pressed onto the drive post 106 and the socket wrench 102, and the user must then manually rotate the socket 104, the socket wrench 102 or the drive post 106 until the socket 104 is aligned with the drive post 106. Such rotation is in a rotation direction 306 about a longitudinal axis 308 of the drive post 106. The socket 104 is removed from the socket wrench 102 by pulling the socket 104 off of the drive post 106, retracting the balls of the drive post 106 either by the pulling action or by pressing the spring-loaded post 202.

Interchangeable sockets are also usable with torque wrenches, nut drivers, breaker bars and impact drivers, although sockets for the latter two generally require specially hardened steel. Socket wrenches and torque wrenches usually have a lever that establishes or reverses direction of a ratchet mechanism, which nut drivers and breaker bars lack. Impact drivers are usually one-way, for loosening stuck nuts or bolts, and can have an electric motor or an impact head that is manually hit with a hammer. Sockets are available in short, medium and extended lengths, and with special inserts for spark plugs. Improvements in the sockets are sought.

SUMMARY

An interchangeable socket for a socket wrench, torque wrench, nut driver, breaker bar or impact driver is herein disclosed. The socket has a fastener-receiving end. The fastener-receiving end is dimensioned to receive and fit a specified fastener. The socket has a post-receiving end. The post-receiving end is dimensioned to receive and fit a square cross-section drive post.

The post-receiving end has a square cross-section hollow bounded by four walls. The four walls intersect at corners of the square cross-section hollow.

The post-receiving end has guide surfaces. The guide surfaces intersect with the four walls and with each other. The guide surfaces cooperate with the drive post to rotate and align the drive post with a square cross-section hollow during insertion of the drive post to the socket. The guide surfaces are symmetric with respect to the four walls. The guide surfaces are symmetric with respect to the corners of the square cross-section hollow. There may be at least four guide surfaces, each sloping downward towards a respective nearest one of the corners of the square cross-section hollow.

At least one embodiment has a triangular guide surfaces. The triangular guide surfaces cooperate with the drive post to rotate and align the drive post with the square cross-section hollow during insertion of the drive post to the socket. Each of the triangular guide surfaces slopes downward towards a respective one of the corners of the square cross-section hollow. Each of the triangular guide surfaces slopes downward from a respective high point between the respective one of the corners and a neighboring one of the corners of the square cross-section hollow of the socket. The eight triangular guide surfaces are symmetrically located with respect to the corners of the square cross-section hollow.

DETAILED DESCRIPTION

Figure 1:
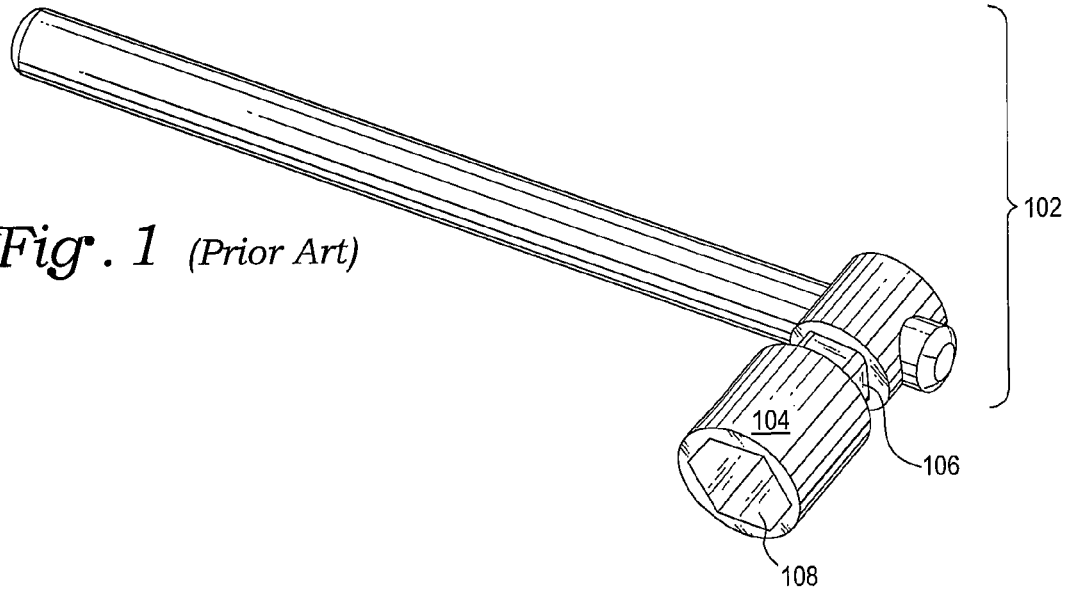
Fig. 1 (Prior Art)
FIG. 1 is a front perspective view of a prior art socket and socket wrench.
Figure 2:
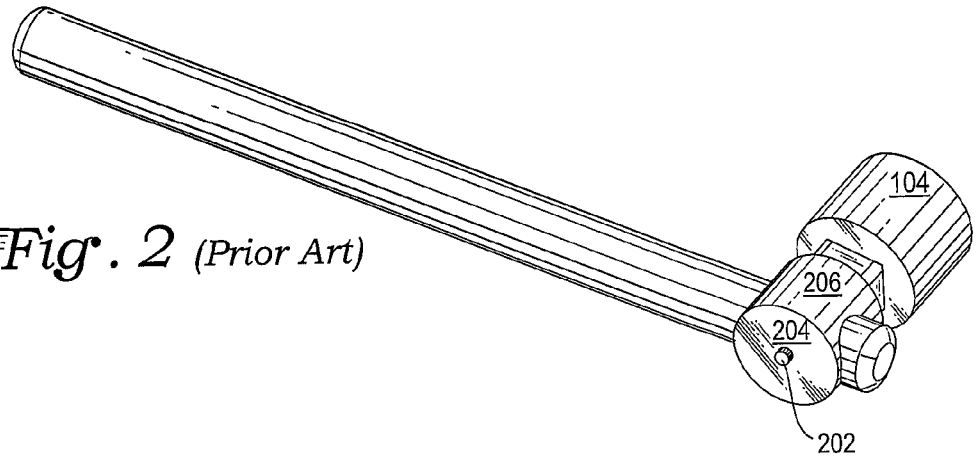
Fig. 2 (Prior Art)
FIG. 2 is a rear perspective view of the prior art socket and socket wrench of FIG. 1.
Figure 3:
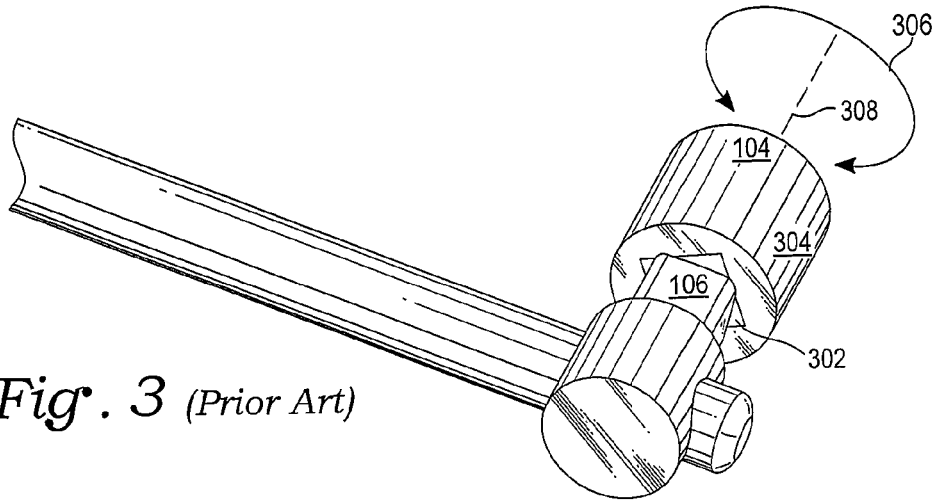
Fig. 3 (Prior Art)
FIG. 3 is a rear perspective view of the prior art socket of FIG. 1 misaligned with the drive post of the prior art socket wrench of FIG. 1, prior to insertion of the drive post to the socket.
Figure 4:
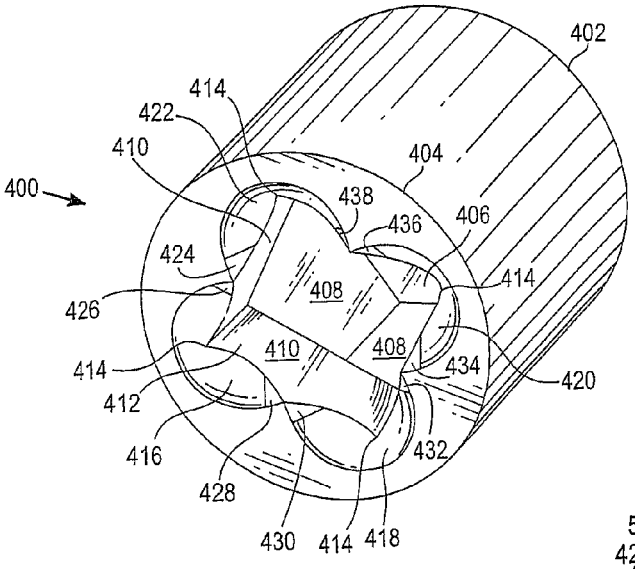
FIG. 4 is a perspective view of an improved, interchangeable socket in accordance with the present invention.
Figure 5:
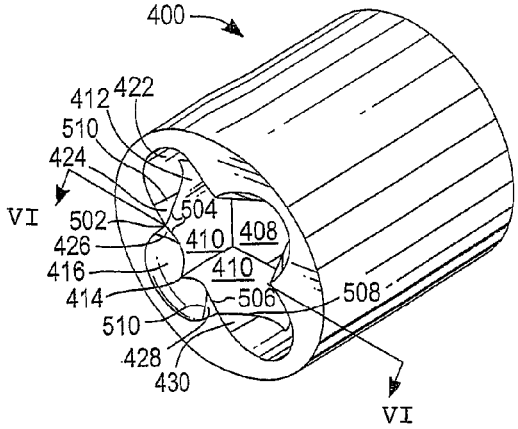
FIG. 5 is a further perspective view of the improved, interchangeable socket of FIG. 4.
Figure 6:
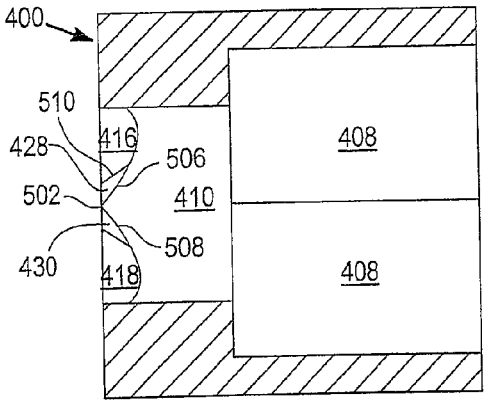
FIG. 6 is a cross-section view of the improved, interchangeable socket of FIG. 4.
Figure 7:
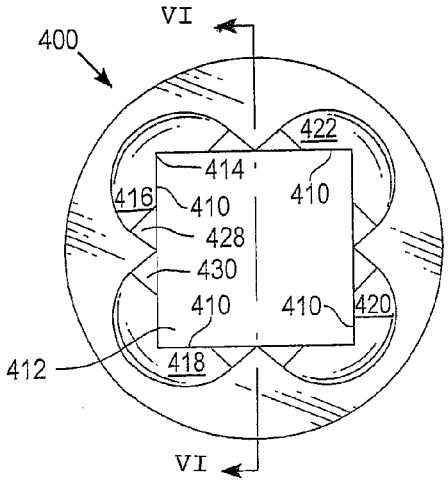
FIG. 7 is a top view of the improved, interchangeable socket of FIG. 4.

With reference to FIGS. 4-20, embodiments of an interchangeable socket 400 are shown, as an improvement over the prior art socket and socket wrench of FIGS. 1-3. The improved, interchangeable socket 400 fits socket wrenches 102, torque wrenches, nut drivers, breaker bars or impact drivers (not shown, but known) or other tools having a square cross-section drive post 106. The improved interchangeable socket 400 and further embodiments thereof solve a problem of how to blindly and/or more quickly and efficiently attach a socket to a socket wrench or other such tool. Increased efficiency in the operation of changing sockets and a decrease in the dropping of the interchangeable sockets due to misalignment with a drive post 106 during such operation are results directly attributable to the improved, interchangeable socket 400 and embodiments thereof.

With reference to FIGS. 4-7, a fastener-receiving end 402 of the socket 400 is dimensioned to receive and fit a specified fastener, such as a hex bolt head or hex nut. Embodiments dimensioned to fit hex bolt heads or hex nuts include six-point and twelve point sockets. Further embodiments have the fastener-receiving end of the socket dimensioned to fit Phillips head screws, slotted screws, hex socket screws (i.e. that require a hex wrench), Torx™ bolts and other types of known fasteners. The fastener-receiving end 402 is similar or identical to the fastener-receiving end of known interchangeable sockets. In further embodiments, new fastener-receiving ends may be devised to fit specified fasteners. In the embodiment shown in FIG. 4, the fastener-receiving end 402 has a hexagonal opening 406 surrounded by six fastener-accepting walls 408.

A post-receiving end 404 of the socket 400 opposes the fastener-receiving end 402. The post-receiving end 404 is dimensioned to receive and fit the square cross-section drive post 106, and accordingly has a square cross-section hollow 412 bounded by four walls 410. The four walls 410 intersect at the corners 414 of the square cross-section hollow 412. Throughout the remainder of the description, various details are described relative to an orientation of the socket with the post-receiving end 404 facing upwards. Such orientation is for purpose of description. Orientation of the socket and relative orientation of the features are understood to be gravitationally independent.

Improvements to the socket include guide surfaces 416, 418, 420, 422, 424, 426, 428, 430, 432, 434, 436, 438 that cooperate with the drive post 106, to rotate and align the drive post 106 with the square cross-section hollow 412 during insertion of the drive post 106 to the socket 400. The guide surfaces are symmetric with respect to the four walls 410. The guide surfaces are further symmetric with respect to the corners 414 of the square cross-section hollow 412. The guide surfaces and the embodiments of the socket 400 are described below, followed by a discussion of features and aspects.

With continued reference to FIGS. 4-7, the improved, interchangeable socket 400 is shown with added guide surfaces that act as socket guide features or coupling features, to improve the coupling of the socket 400 to the drive post 106 of the socket wrench 102 or other tool. The socket guide features induce the rotation of the square cross-section drive post 106 or the rotation of the socket 400 upon insertion of the drive post 106 into the square cross-section hollow 412 at the post-receiving end 404 of the socket 400.

In the embodiment of the improved, interchangeable socket shown in FIGS. 4-7, the guide surfaces include four smoothly rounded concave surfaces 416, 418, 420, 422. The guide surfaces slope downwards towards the four walls. Each of these smoothly rounded concave surfaces 416, 418, 420, 422 is symmetric about a respective one of the corners 414 of the square cross-section hollow 412 of the socket 400. For example, the smoothly rounded concave surface 416 slopes downward towards two of the walls 410 that intersect at a corner 414, and the smoothly rounded concave surface 416 is symmetric about this corner 414.

The guide surfaces further include four pairs of flat triangular facets 424, 426, 428, 430, 432, 434, 436, 438. Each pair of triangular facets 424, 426 shares a vertex at a respective midpoint 502 of the top edge 504 of one of the four walls 410 of the square cross-section hollow. This midpoint 502 of the top edge 504 is also a high point of the top edge 504 of the wall 410, as all other portions of the top edge 504 of the wall 410 are at a lower elevation relative to this high point. Each of the triangular facets 428, 430 shares an edge 506, 508 with a respective one of the four walls 410. Each of the triangular facets 424 shares a further edge 510 with a respective one of the smoothly rounded concave surfaces 422.

The triangular facets 424, 426, 428, 430, 432, 434, 436, 438 each provide a flat, angled sliding surface that guides the drive post 106 or the socket 400 into rotation upon contact of the drive post 106 and the guide surfaces. Each triangular facet 424, 426, 428, 430, 432, 434, 436, 438 guides the contacting portion of the drive post 106 away from the shared vertex and high point 502 of the top edge 504 of the wall 410. The triangular facet 428 guides the contacting portion of the drive post 106 towards the respective corner 414 of the square cross-section hollow 412 of the socket 400 with which the drive post 106 is being brought into alignment. As the contacting portion of the drive post 106 passes from the triangular facet 428 to the smoothly rounded concave surface 416, passing over the shared edge 510, the smoothly rounded concave surface 416 takes over and guides the contacting portion of the drive post 106 towards the corner 414 of the square cross-section hollow 412. The guide surfaces work in concert, bringing the drive post 106 and the square cross-section hollow 412 into alignment, after which the socket 400 can be seated on the drive post 106.

Figure 8:
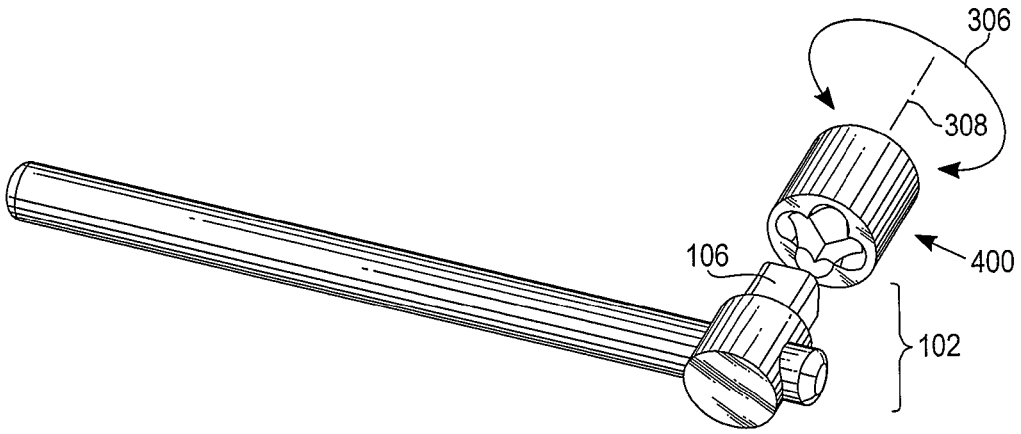
FIG. 8 is a perspective view of the improved, interchangeable socket of FIG. 4 approaching the prior art socket wrench of FIGS. 1-3.

With reference to FIG. 8, a rotational misalignment of the socket 400 relative to the drive post 106 of a socket wrench 102 is shown, as the socket 400 approaches the drive post 106. As can be seen, in this example the drive post of the socket wrench is rotated between about one eighth of a turn and one quarter of a turn relative to the socket and vice versa. The rotation is in a rotation direction 306 about the longitudinal axis 308 of the drive post 106.

Figure 9:
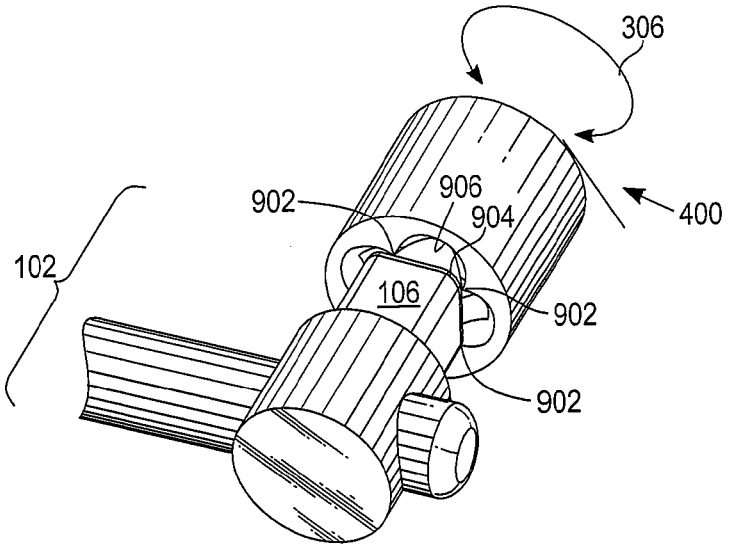
FIG. 9 is a perspective view of the improved, interchangeable socket of FIG. 4 rotating as a result of added guide surfaces of the socket contacting the drive post of the prior art socket wrench of FIGS. 1-3.

With reference to FIG. 9, the guide surfaces 902 of the socket 400 are shown contacting portions of the drive post 106 of the socket wrench 102. Pressing the socket 400 onto the socket wrench 102 and onto the drive post 106 induces rotation in the rotation direction 306 of the drive post 106 and/or the socket 400. The induced rotation is a result of the angular contact of the drive post 106 surfaces and the guide surfaces 902 of the socket 400. The symmetrical arrangement of the guide surfaces 902 induces rotation of the drive post 106 and/or the socket 400 so that each corner 904 of the drive post is guided towards the nearest corner 906 of the square cross-section hollow of the socket 400. The guide surfaces 902 and the socket 400 can be scaled larger or smaller, so that a set of sockets can be produced with sockets of various sizes over a range as is commonly the case with socket sets.

Figure 10:
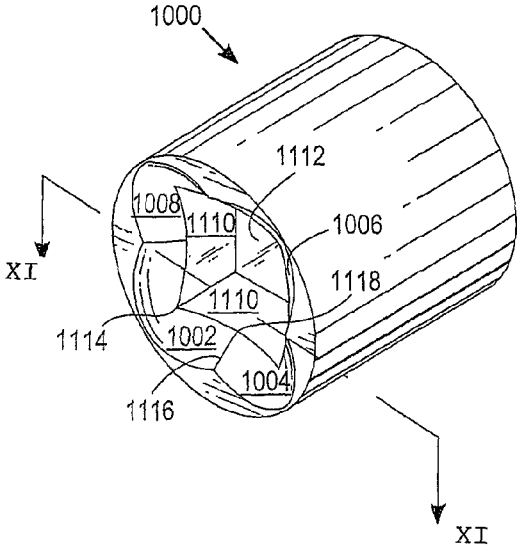
FIG. 10 is a perspective view of a further embodiment of the improved, interchangeable socket of FIG. 4.
Figure 11:
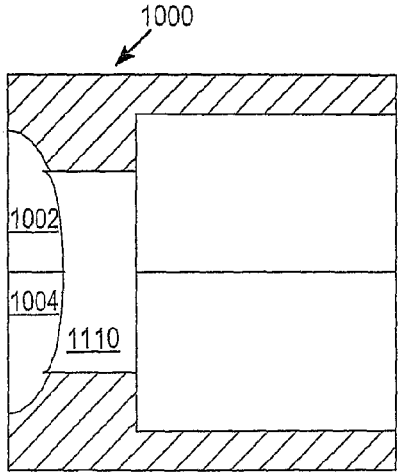
FIG. 11 is a cross-section view of the improved, interchangeable socket of FIG. 10.
Figure 12:
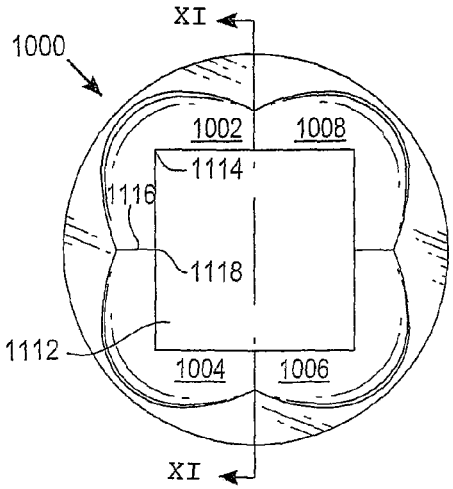
FIG. 12 is a top view of the improved, interchangeable socket of FIG. 10.

With reference to FIGS. 10-12, an embodiment of the improved, interchangeable socket 1000 is shown having guide surfaces that include four smoothly rounded concave surfaces 1002, 1004, 1006, 1008. The smoothly rounded concave surfaces 1002, 1004, 1006, 1008 slope downwards towards the four walls 1110 of the square cross-section hollow 1112 of the socket. Each of the smoothly rounded concave surfaces 1002 is symmetric about a respective one of the corners 1114 of the square cross-section hollow 1112. Neighboring ones of the smoothly rounded concave surfaces 1002, 1004 intersect along shared edges 1116, i.e. each pair of smoothly rounded concave surfaces 1002, 1004 shares a common edge 1116. Each of these edges 1116 slopes downwards towards a respective midpoint 1118 of a top edge 1120 of one of the four walls 1110. A portion of a drive post 106 landing on such a common edge 1116 shared by two of the smoothly rounded concave surfaces 1002, 1004 tends to fall to one side or the other of the common edge 1116, whereupon the smoothly rounded concave surface 1002 on that side of the common edge 1116 guides the portion of the drive post towards the nearest corner 1114 of the square cross-section hollow 1112.

Figure 13:
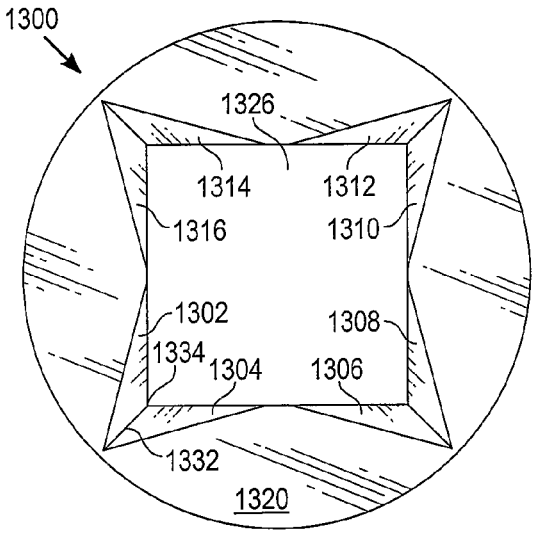
FIGS. 13-20 are top views and perspective views of further embodiments of the improved, interchangeable socket of FIG. 4.
Figure 14:
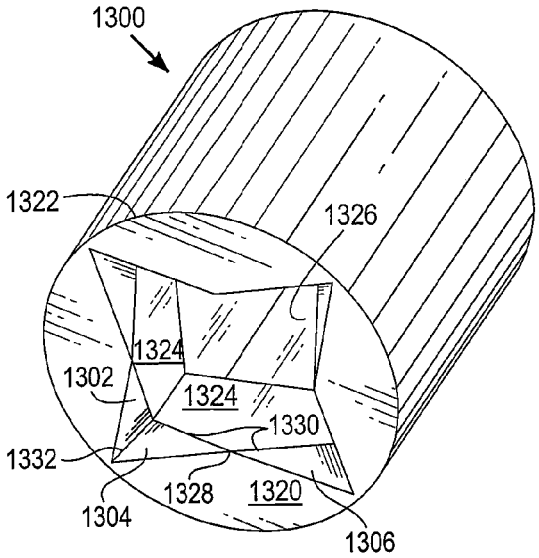

With reference to FIGS. 13 and 14, an embodiment of the improved, interchangeable socket 1300 is shown having guide surfaces that include eight triangular facets 1302, 1304, 1306, 1308, 1310, 1312, 1314, 1316. The guide surfaces are sunken from a flat or planar end face 1320 of the drive post-receiving end 1322 of the socket 1300. Each of the triangular facets slopes downwards towards a respective one of the four walls 1324 of the square cross-section hollow 1326 of the socket 1300. Each of the triangular facets 1304 shares a vertex of the neighboring one of the triangular facets 1306. This vertex is at a respective midpoint and high point 1328 of a top edge 1330 of one of the four walls 1324. Each of the triangular facets 1302 shares an edge 1332 with a further neighboring one of the triangular facets 1304. This shared edge 1332 forms the bottom of a groove that slopes downwards to a respective one of the corners 1334 of the square cross-section hollow 1326 of the socket 1300. The groove is formed by the two neighboring triangular facets 1302, 1304.

Figure 15:
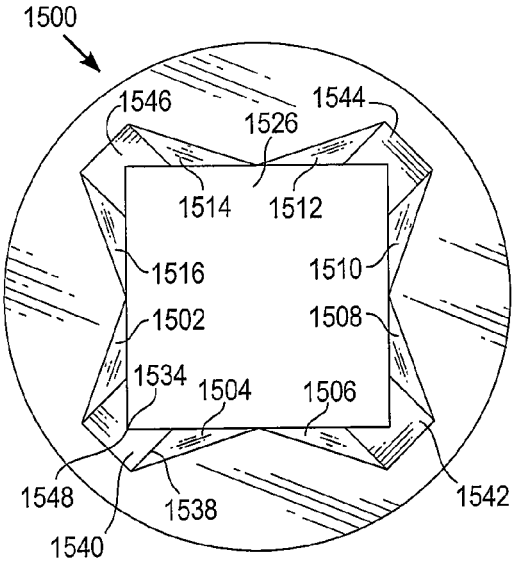
Figure 16:
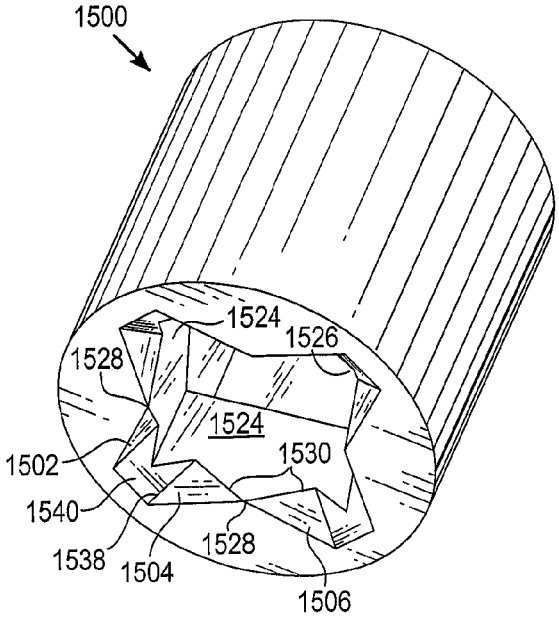

With reference to FIGS. 15 and 16, an embodiment of the improved, interchangeable socket 1500 is shown having guide surfaces that include four flat polygonal surfaces 1540, 1542, 1544, 1546 and eight triangular facets 1502, 1504, 1506, 1508, 1510, 1512, 1514, 1516. In this example, each of the flat polygonal surfaces 1540, 1542, 1544, 1546 is a concave polygon, namely a concave pentagon, intersecting a respective one of the four corners 1534 of the square cross-section hollow 1526 of the socket 1500. The greater than 180 degrees internal angle 1548 of the concave polygon 1540 is centered at and symmetric to the respective corner 1534 of the square cross-section hollow 1526. Each of the flat concave polygonal surfaces 1540 slopes downward towards the respective one of the four corners 1534 of the square cross-section hollow 1526.

Each of the eight triangular facets 1502, 1504, 1506, 1508, 1510, 1512, 1514, 1516 slopes downward towards a respective one of the four walls 1524 of the square cross-section hollow 1526 of the socket 1500. Each of the eight triangular facets 1504 shares a vertex of the neighboring one of the triangular facets 1506. This vertex is at a respective midpoint and high point 1528 of a top edge 1530 of one of the four walls 1524. Each of the eight triangular facets 1504 shares an edge 1538 with a respective one of the four flat polygonal surfaces 1540. Each of the four flat polygonal surfaces 1540 is flanked by two of the triangular facets 1502, 1504, one to each side.

Figure 17:
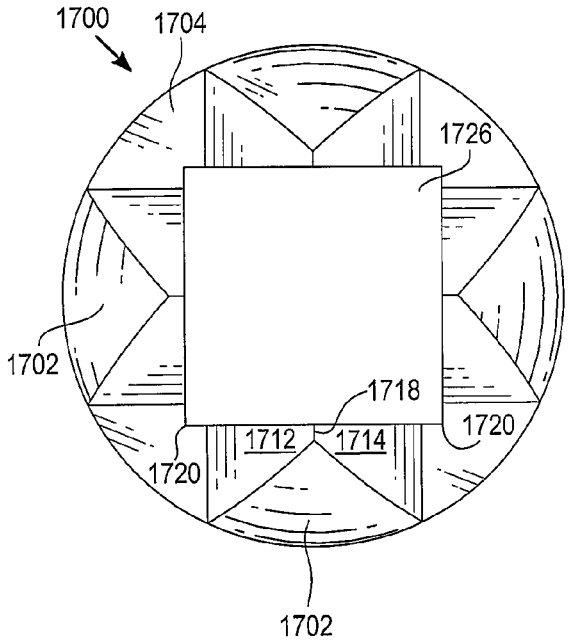
Figure 18:
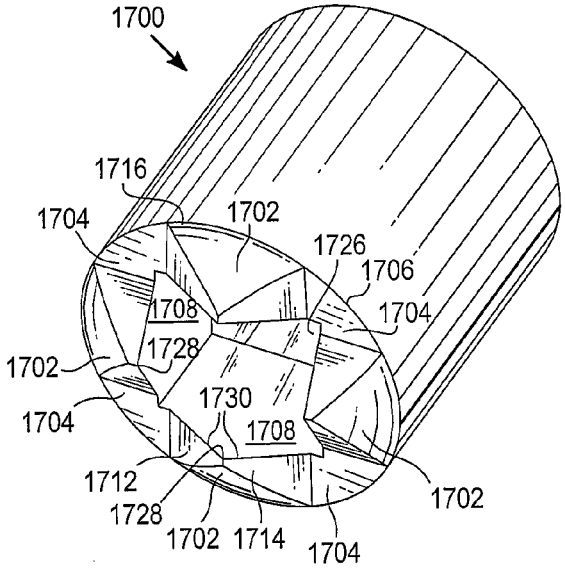

With reference to FIGS. 17 and 18, an embodiment of the improved, interchangeable socket 1700 is shown having guide surfaces that form four prongs 1702 protruding upwards from a planar surface 1704 or end plane of the post-receiving end 1706 of the socket 1700. Each prong 1702 protrudes upward from between two adjacent corners 1720 of the square cross-section hollow 1726 of the socket 1700. Each of the prongs 1702 is centered relative to a respective one of the four walls 1708 of the square cross-section hollow 1726 of the socket 1700. Each of the prongs 1702 includes a portion of the respective one of the four walls 1708. Each of the prongs has a respective high point at a midpoint and high point 1728 of a top edge 1730 of the respective one of the four walls 1708. Each of the prongs 1702 has two faces 1712, 1714. The faces 1712, 1714 descend in opposing directions from the respective high point 1728. The faces 1712, 1714 descend to the planar surface 1704 of the post-receiving end 1716 of the socket 1700. In the example shown, the two faces 1712, 1714 of each prong 1702 are each approximately triangular. The two faces 1712, 1714 of each prong share either a point at, or a short edge 1718 ending at, the high point 1728 of the respective one of the four walls 1708.

Figure 19:
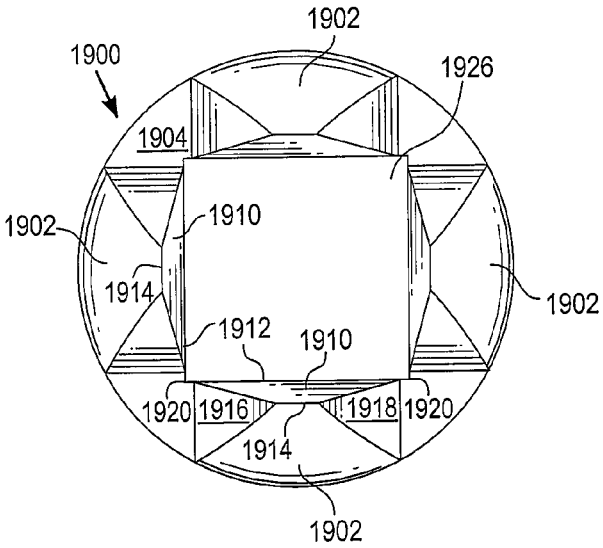
Figure 20:
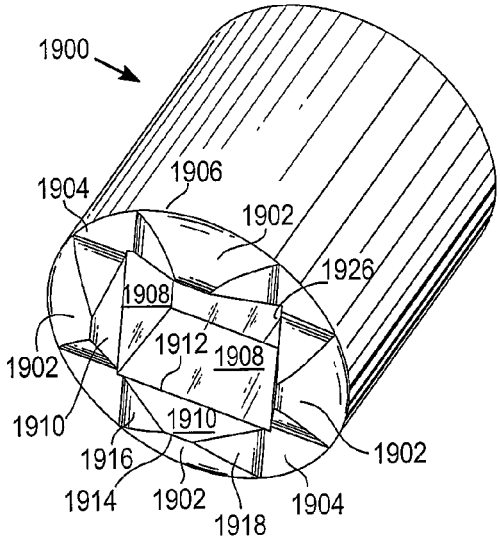

With reference to FIGS. 19 and 20, an embodiment of the improved, interchangeable socket 1900 is shown having guide surfaces that form four prongs 1902 protruding upwards from a planar surface 1904 or end plane of the post-receiving end 1906 of the socket 1900. Each prong 1902 protrudes upward from between two adjacent corners 1920 of the square cross-section hollow 1926 of the socket 1900. Each of the prongs 1902 is centered relative to a respective one of the four walls 1908 of the square cross-section hollow 1926 of the socket 1900. Each of the prongs 1902 has a trapezoidal face 1910. The trapezoidal face 1910 is tilted outwards from the base 1912. The base of the trapezoidal face is shared with a top edge of the respective one of the four walls 1908 of the square cross-section hollow 1926 of the socket 1900. The top edge 1914 of each trapezoidal face 1910 is an uppermost edge of the respective prong 1902. Each of the prongs 1902 has two faces 1916, 1918 descending in opposing directions from opposed ends of the top edge 1914 of the trapezoidal face 1910. Each of the two faces 1916, 1918 descends to the planar surface 1904 of the post-receiving end 1906 of the socket 1900. The two faces 1916, 1918 flank the respective trapezoidal face 1910.

Many of the embodiments of the improved interchangeable socket have commonalties. With reference to FIGS. 4-7, 13-16, 19 and 20, embodiments of the improved, interchangeable socket are shown that have eight triangular guide surfaces. FIGS. 17 and 18 show embodiments with approximately triangular guide surfaces. The triangular guide surfaces cooperate with the drive post to rotate and align the drive post with the square cross-section hollow during insertion of the drive post to the socket. Each of the triangular guide surfaces slopes downward towards a respective one of the corners of the square cross-section hollow of the socket. Each of the triangular guide surfaces slopes downward from a respective high point between the respective one of the corners and the neighboring one of the corners of the square cross-section hollow. The eight triangular guide surfaces are symmetrically located with respect to the corners of the square cross-section hollow.

In embodiments of the improved, interchangeable socket shown in FIGS. 4-12, the post-receiving end of the socket has four curved concave surfaces. Each of the curved concave surfaces is symmetric about and slopes downward towards a respective one of the corners of the square cross-section section hollow of the socket. Each of the four concave surfaces is flanked by and shares edges with two of the triangular guide surfaces.

In embodiments of the improved, interchangeable socket shown in FIGS. 4-7 and 13-16, the triangular guide surfaces are paired. The respective high point of each of the triangular guide surfaces is at a respective midpoint of a top edge of one of the four walls. FIGS. 17 and 18 show embodiments with approximately triangular guide surfaces that are paired and have a shared high point at a respective midpoint of a top edge of one of the four walls.

In embodiments of the improved, interchangeable socket shown in FIGS. 19 and 20, the triangular guide surfaces are paired. The respective high point of each of the triangular guide surfaces is adjacent to a respective midpoint of a top edge of one of the four walls.

In embodiments of the improved, interchangeable socket shown in FIGS. 4-7 and 13-16, each of the triangular guide surfaces shares an edge with a respective one of the four walls. FIGS. 17 and 18 show embodiments with approximately triangular guide surfaces each of which shares an edge with a respective one of the four walls.

In embodiments of the improved, interchangeable socket shown in FIGS. 4-20, the post-receiving end has at least four guide surfaces that cooperate with the drive post to rotate and align the drive post with the square cross-section hollow of the socket during insertion of the drive post to the socket. Each of the guide surfaces slopes downward towards a respective nearest one of the corners of the square cross-section hollow.

In embodiments of the improved, interchangeable socket shown in FIGS. 4-16, each of the guide surfaces descends from an end plane of the post-receiving end of the socket.

In embodiments of the improved, interchangeable socket shown in FIGS. 4-16, each of the guide surfaces forms a portion of a sunken region surrounding the respective nearest one of the corners of the square cross-section hollow.

In embodiments of the improved, interchangeable socket shown in FIGS. 17-20, each of the guide surfaces rises from an end plane of the post-receiving end of the socket.

In embodiments of the improved, interchangeable socket shown in FIGS. 17-20, each of the guide surfaces forms a portion of a respective prong protruding upwards from between two adjacent corners of the square cross-section hollow.

Further embodiments can combine aspects of the embodiments shown. Further embodiments may have softening of the edges of polygonal shapes and joinings of shapes, as by introduction of slight curvature of or at the edges. Examples of such softening include altering the triangular surfaces to be slightly rounded triangular surfaces, and radiusing or blending an edge where two planar surfaces join.

What is claimed is:

1. An interchangeable socket for a socket wrench, torque wrench, nut driver, breaker bar or impact driver, comprising:

a socket having a fastener-receiving end dimensioned to receive and fit a specified fastener and a post-receiving end dimensioned to receive and fit a square cross-section drive post, the post-receiving end having:

a square cross-section hollow bounded by four walls intersecting at corners of the square cross-section hollow; and guide surfaces that intersect with the four walls and with each other, and cooperate with the drive post to rotate and align the drive post with the square cross-section hollow during insertion of the drive post to the socket, the guide surfaces being symmetric with respect to the four walls and the corners of the square cross-section hollow;

wherein the guide surfaces include: four smoothly rounded concave surfaces that slope downwards towards the four walls and are each symmetric about a respective one of the corners of the square cross-section hollow; and four pairs of flat triangular facets, each such pair sharing a vertex at a respective midpoint and high point of a top edge of one of the four walls, each of the triangular facets sharing an edge with a respective one of the four walls and sharing a further edge with a respective one of the smoothly rounded concave surfaces.

2. An interchangeable socket for a socket wrench, torque wrench, nut driver, breaker bar or impact driver, comprising:

a socket having a fastener-receiving end dimensioned to receive and fit a specified fastener and a post-receiving end dimensioned to receive and fit a square cross-section drive post, the post-receiving end having:

a square cross-section hollow bounded by four walls intersecting at corners of the square cross-section hollow; and eight triangular guide surfaces that cooperate with the drive post to rotate and align the drive post with the square cross-section hollow during insertion of the drive post to the socket, each of the triangular guide surfaces sloping downward towards a respective one of the corners of the square cross-section hollow from a respective high point between the respective one of the corners and a neighboring one of the corners of the square cross-section hollow, the eight triangular guide surfaces being symmetrically located with respect to the corners of the square cross-section hollow;

the post receiving end of the socket having four curved concave surfaces, each of which is:

symmetric about and slopes downwards towards a respective one of the corners of the square cross-section hollow; and flanked by and sharing edges with two of the triangular guide surfaces.

3. The interchangeable socket of claim 2 wherein each of the triangular guide surfaces shares an edge with a respective one of the four walls.

* * * * *